US005091020A

United States Patent [19]

Kim

[11] Patent Number: 5,091,020

[45] Date of Patent: Feb. 25, 1992

[54] METHOD AND PARTICLE MIXTURE FOR MAKING RARE EARTH ELEMENT, IRON AND BORON PERMANENT SINTERED MAGNETS

[75] Inventor: Andrew S. Kim, Pittsburgh, Pa.

[73] Assignee: Crucible Materials Corporation, Syracuse, N.Y.

[21] Appl. No.: 616,099

[22] Filed: Nov. 20, 1990

[51] Int. Cl.[5] ..... H01F 1/02

[52] U.S. Cl. ..... 148/101; 148/103; 148/104; 419/12; 419/19; 419/20; 419/32; 419/33

[58] Field of Search ..... 148/101, 103, 104; 419/12, 19, 20, 32, 33

[56] References Cited

U.S. PATENT DOCUMENTS 4,853,045 8/1989 Rozendaal ..... 148/103
4,857,118 8/1989 Van Mens ..... 148/103

FOREIGN PATENT DOCUMENTS 63-90104 4/1988 Japan ..... 148/104

*Primary Examiner*—John P. Sheehan
*Attorney, Agent, or Firm*—Finnegan, Henderson, Farabow, Garrett & Dunner

[57] ABSTRACT

A method for making rare earth element, iron and boron sintered permanent magnets, and a particle mixture for use therein. A hydrided 100% dross or particle mixture of virgin alloy particles and scrap alloy particles and/or dross alloy particles are dehydrided and sintered to produce a substantially fully dense article for use as a permanent magnet.

13 Claims, No Drawings

METHOD AND PARTICLE MIXTURE FOR MAKING RARE EARTH ELEMENT, IRON AND BORON PERMANENT SINTERED MAGNETS

BACKGROUND OF THE INVENTION

1. Field of the Invention

The invention relates to a method for making rare earth element, iron and boron sintered permanent magnets from dross or alloy scrap containing a rare earth element, iron and boron, and to an alloy particle mixture for use therein.

2. Description of the Prior Art

During the production of permanent magnet alloys of a rare earth element-iron-boron in a vacuum induction furnace approximately 5 to 10% of the furnace charge material is formed into dross during this melting operation. This dross typically contains very high oxygen and nitrogen contents, on the order of 0.5 to 4.5 weight % and 0.1 to 3.0 weight %, respectively. Upon the conclusion of the vacuum induction melting operation, the dross is formed on the surface of the melted alloy and thus may be readily removed from the furnace. The dross contains $Nd_2Fe_{14}B$ matrix phase, Nd oxide and Nd nitride, and an alpha iron phase. Because of the very high oxygen and nitrogen contents, it is difficult to densify dross to levels sufficient for the production of permanent magnet articles by conventional sintering practices. Consequently, dross is typically disposed of as a waste material.

In the manufacture of rare earth element-iron boron permanent magnets by conventional powder metallurgy techniques, such as sintering, there are some magnets that do not meet the manufacturing specifications, such as magnetic properties, dimension, physical integrity, corrosion resistance and the like. These magnets are thus rejected as scrap or revert material. It is difficult to reprocess scrap directly into permanent magnet articles by conventional powder metallurgy techniques, such as sintering. Specifically, if the scrap is crushed to form powder and the powder is pressed and sintered in a conventional manner, it is difficult to achieve the required high densities for permanent magnet articles because of the relatively high oxygen content, e.g. 0.3 to 1.5% of the scrap.

Attempts have been made to recover the rare earth element-iron-boron alloy content from dross and scrap materials by various processes, including remelting the dross or scrap with reducing agents such as calcium (Ca) or calcium hydride ($CaH_2$), reduction and diffusion or thermite reduction. With remelting practices, the yields are extremely poor and generally do not warrant the remelting cost involved. In addition, the remelted alloy is generally contaminated from the reducing agents and refractory materials to render it unsatisfactory for use in permanent magnet production.

OBJECTS OF THE INVENTION

It is accordingly a primary object of the present invention to provide a method for producing particles from dross or scrap containing a rare earth element, iron and boron alloy, which particles are suitable for use in the manufacture of sintered permanent magnets.

An additional object of the invention is to provide particles produced from dross or scrap containing a rare earth element, iron and boron alloy which may be mixed together or mixed with virgin alloy particles to produce a mixture of particles suitable for use in the manufacture of sintered permanent magnet articles.

SUMMARY OF THE INVENTION

In accordance with the invention, a mixture of particles of a permanent magnet alloy of a rare earth element, iron and boron, is provided for use in producing sintered permanent magnets. The mixture constitutes one of:

- hydrided dross alloy particles;
- hydrided dross alloy particles and virgin alloy particles in admixture;
- up to 60% hydrided scrap alloy particles and the balance hydrided dross alloy particles in admixture; and
- up to 80% hydrided scrap alloy particles and the balance hydrided dross alloy particles and hydrided virgin alloy particles in admixture.

The rare earth element of the alloy is at least one rare earth element which may be neodymium or neodymium and dysprosium in combination.

In accordance with the method of the invention, sintered permanent magnets are produced of a permanent magnet alloy of a rare earth element, iron and boron by providing permanent magnet alloy material of one of:

- hydrided dross alloy;
- hydrided dross alloy and virgin alloy in admixture;
- up to 60% hydrided scrap alloy and the balance hydrided dross alloy in admixture; and
- up to 80% hydrided scrap alloy and the balance hydrided dross alloy and hydrided virgin alloy in admixture.

One of the aforementioned materials is subjected to a hydrogen atmosphere to hydride and decrepitate the material to form particles therefrom. The size of these particles is reduced and thereafter the particles are dehydrided and sintered to produce a substantially fully dense article for use as a permanent magnet.

Preferably, the size of the particles is reduced by a jet milling operation.

Preferably, the particles are blended with 0.01 to 1 weight percent of a lubricant prior to the jet milling operation. The lubricant may include zinc stearate or iron stearate.

The average particle size of the jet milled powder is 1 to 4 microns by Fischer Subsieve Size measurement.

The hydrogen atmosphere is preferably at a pressure of 1 to 400 psi and the material maintained therein for two to four hours. The hydrogen atmosphere is preferably at a room temperature or a temperature within the range of 200° to 300° C.

The substantially fully dense article for use as a permanent magnet is heat treated at a temperature of 550° to 650° C. for one to three hours in either an inert atmosphere or vacuum and is then quenched.

DESCRIPTION OF THE PREFERRED EMBODIMENTS

In accordance with the specific embodiments of the invention the dross or scrap magnet material containing an alloy of a rare earth element, iron and boron, which rare earth element may be neodymium, was placed in a hydriding chamber that was evacuated to 10–100 microns followed by argon gas backfilling. The chamber was then subjected to a plurality of argon flushing operations and then hydrogen gas was introduced into the chamber at a pressure of about 1 to 400 psi. Hydrogen decrepitation was then initiated at room temperature or at an elevated temperature of, for example, 200°-300° C. The hydrogen decrepitation process was continued at 1 to 400 psi for 2 to 4 hours depending upon the pressure level. After hydrogen decrepitation, the chamber was cooled to room temperature. The chamber was then evacuated to remove hydrogen and backfilled with argon prior to removing the dross or scrap work product. The virgin alloy was hydrided by using this same practice. The hydrided powder was then jet milled to fine particle size with the average size being 1-4 microns. The jet milling operation was conducted by using nitrogen or argon gas.

The jet milled scrap and/or dross powder was blended together or blended with jet milled virgin alloy powder to the proper ratio for the desired high magnetic properties and full density upon subsequent sintering. Alternately, the dross powder was used alone without blending. The hydrided particles may also be blended prior to jet milling. The particles were aligned in a magnetic field and isostatically pressed into a compact which was sintered at a temperature of 900° to 1100° C. for 1 to 4 hours in either a vacuum or an inert gas atmosphere, such as argon. Dehydriding resulted during this sintering operation. The sintered magnet compact was heat treated at about 900° C. for 1 hour. Thereupon, a further heat treatment at 550°-650° C. for 1 to 3 hours in an argon atmosphere followed by quenching, or in vacuum followed by quenching, was employed to improve the magnetic properties.

As a result of the above-described process the typical magnetic properties and density of magnets made from the indicated blended particle mixtures by isostatic pressing are as follows:

| Blends | D (g/cc) | Br (KG) | Hci (kOe) | (BH) max (MGO) |
|---|---|---|---|---|
| 100% $Nd_{15}Fe_{79}B_6$ (virgin alloy) | 7.54 | 12.5 | 12.8 | 37.2 |
| 60% scrap + 40% virgin alloy | 7.56 | 13.1 | 10.35 | 40.6 |
| 60% dross + 40% virgin alloy | 7.49 | 12.0 | 13.9 | 33.3 |
| 50% scrap + 30% dross + 20% virgin alloy | 7.52 | 12.15 | 13.6 | 35.8 |
| 50% dross + 50% scrap | 7.59 | 11.6 | 18.5 | 33.1 |
| 100% dross | 7.57 | 11.1 | 18.6 | 30.3 |

The particle blend of scrap and virgin alloy exhibited magnetic properties similar to those of the virgin alloy alone. On the other hand, blends of dross and virgin alloy or scrap exhibited magnetic properties slightly lower than those of the virgin alloy. Increased dross content in the blend caused a reduction in the remanence value (Br) and energy product (BHmax) and increase in intrinsic coercivity (Hci). The blends of virgin alloy with a combination of dross and scrap particles exhibited comparable magnetic properties to those of the blends of virgin alloy and dross.

The materials listed in Table 1 were used by way of examples to demonstrate the invention.

TABLE 1

Chemical Compositions of Selected Materials (by wt %)

| | Nd | Dy | Fe | B | O | N |
|---|---|---|---|---|---|---|
| Dross 3 | 36.5-38.5 | 0-2.0 | Bal | 1.0 | 1.2 | 1.7 |
| Scrap 3 | 31.5-33.5 | 0-2.0 | Bal | 1.0 | 0.9 | 0.04 |

TABLE 1-continued

Chemical Compositions of Selected Materials (by wt %)

| | Nd | Dy | Fe | B | O | N |
|---|---|---|---|---|---|---|
| Alloy 3 | 34.0 | — | Bal | 1.0 | <0.05 | <0.005 |

Alloy 3 constitutes atomized virgin alloy. The dross 3, scrap 3 and alloy 3 were separately crushed, pulverized and jet milled into fine powders with an average powder particle size of 1 to 4 microns. Jet milling was performed by the use of nitrogen gas. The jet milled powders were blended as set forth in Table 2.

TABLE 2

Density and Magnetic Properties of Magnets (Sintered at 1080° C.) Made From Various Powder Blends

| | D (g/cc) | Br (kG) | Hci (kOe) | (BH) max (MGO) |
|---|---|---|---|---|
| 100% alloy 3 (virgin alloy) | 7.58 | 12.0 | 10.25 | 34.2 |
| 100% scrap 3 | 6.38 | *— | — | — |
| 100% dross 3 | 6.24 | *— | — | — |
| 50% scrap 3 + 50% alloy 3 | 6.40 | *— | — | — |
| 50% dross 3 + 50% alloy 3 | 5.82 | *— | — | — |
| 20% scrap 3 + 80% alloy 3 | 6.83 | *— | — | — |
| 20% dross 3 + 80% alloy 3 | 6.47 | *— | — | — |

*Density too low for magnetic property determination.

The single powder and blended powders were aligned in a magnetic field, pressed isostatically, and sintered under vacuum at 1080° C. for 1.5 hours. All blends of virgin alloy (up to 80%) and scrap or dross powders, including 100% scrap and 100% dross, were not densified. Only the 100% virgin alloy product was fully densified at this sintering temperature. This indicates that reprocessing of scrap or dross by blending with virgin alloy particles to produce sintered magnets cannot be achieved in accordance with these processing conditions which are representative of conventional powder metallurgy processing.

The same materials as listed in Table 1 were hydrided in a hydriding chamber by introducing hydrogen gas at a pressure of about 400 psi for about 2 hours followed by evacuation of the residual hydrogen from the chamber. The hydrided materials were easily broken into coarse powders. The coarse powders were then jet milled into fine powders having an average particle size of 1 to 4 microns with nitrogen gas being employed for the jet milling operation. The hydrided powders were much more effectively jet milled than the unhydrided powders. The jet milled hydrided powders were blended into the specific ratios as listed in Tables 3, 4, 5 and 6, aligned in a magnetic field, pressed isostatically and sintered under vacuum at 1030° C. (or 1050° C.) for 1.5 hours. This sintering temperature is 50° C. lower than that for the unhydrided powders as reported above. Alternately, the hydrided powders were blended into the specific ratios as shown in Table 7 and then jet milled to fine powders with an average particle size of 1 to 4 microns. These jet milled powders were aligned in a magnetic field, pressed isostatically and sintered under vacuum at 1050° C.

TABLE 3

Density and Magnetic Properties of Magnets, Sintered at 1030° C., Made From Blends of Hydrided Scrap and Virgin Alloy Powders

| | D (g/cc) | Br (kG) | Hci (kOe) | (BH) max (MGO) |
|---|---|---|---|---|
| 100% scrap 3 | 6.99 | — | — | — |
| 80% scrap 3 + 20% alloy 3 | 7.22 | — | — | — |
| 60% scrap 3 + 40% alloy 3 | 7.56 | 13.1 | 10.35 | 40.6 |
| 40% scrap 3 + 60% alloy 3 | 7.57 | 13.0 | 10.95 | 40.6 |
| 100% alloy 3 | 7.54 | 12.5 | 12.8 | 37.2 |

TABLE 4

Density and Magnetic Properties of Magnets, Sintered at 1030° C., Made From Blends of Hydrided Dross and Virgin Alloy

| | D (g/cc) | Br (kG) | Hci (kOe) | (BH) max (MGO) |
|---|---|---|---|---|
| 100% dross 3 | 7.34 | 11.2 | 13.25 | 30.4 |
| 80% dross 3 + 20% alloy 3 | 7.46 | 11.9 | 13.9 | 32.8 |
| 60% dross 3 + 40% alloy 3 | 7.49 | 12.0 | 13.9 | 33.3 |
| 40% dross 3 + 60% alloy 3 | 7.52 | 12.2 | 13.4 | 35.1 |
| 20% dross 3 + 80% alloy 3 | 7.56 | 12.6 | 13.65 | 37.8 |
| 100% alloy 3 | 7.54 | 12.5 | 12.8 | 37.2 |

As shown in Table 3, the blends of 60% scrap and 40% virgin alloy and 40% scrap and 60% virgin alloy exhibited full densification equivalent to that of the 100% virgin alloy. The magnetic properties of the blends exhibited remanence values (Br) slightly higher and intrinsic coercivity values (Hci) slightly lower than those of the 100% virgin alloy. Autoclave test results showed that the corrosion resistance of the magnets made from blends of scrap and virgin alloy improved over that of the magnet made from virgin alloy alone. This indicates that by a proper particle mixture in accordance with the invention of hydrided scrap and virgin alloy high performance magnets may be produced comparable to those made from virgin alloy alone.

The hydrided dross and virgin alloy powders were also blended into the ratios as indicated in Table 4. As shown in Table 4, 100% of the hydrided dross powder was partially densified, whereas the blends of up to 80% dross and 20% virgin alloy were substantially fully densified at a sintering temperature of 1030° C. and exhibited reasonably good magnetic properties. The required magnetic properties can be controlled with the proper blending ratio of dross and virgin alloy particles in accordance with the invention.

Because it was recognized as beneficial to make a fully dense magnet from 100% or a maximum amount of dross or scrap particles, it was attempted to improve the sinterability of particles by adding lubricants, such as zinc stearate or iron stearate, prior to jet milling, by reducing the particle size, and by increasing the sintering temperature.

After fully hydrided, the dross, scrap or virgin alloy was blended with 0.1% zinc stearate and jet milled to powder with an average particle size of about 1.8 microns. The dross or scrap powder was isostatically pressed both with and without blending it with the virgin alloy powder. The pressed compacts were sintered under vacuum at 1050° C. for 1.5 hours. They were then heat treated at 890° C. for 1 hour followed by aging at 550° C. for 3 hours. The densities and magnetic properties of these compacts are listed in Table 5.

TABLE 5

Density and Magnetic Properties of Magnets, Sintered at 1050° C., Made From Blends of Hydrided Scrap or Dross and Virgin Alloy Powders (0.1% Zinc Stearate added)

| | D (g/cc) | Br (kG) | Hk (kOe) | Hci (kOe) | (BH) max (MGO) |
|---|---|---|---|---|---|
| 100% dross | 7.57 | 11.1 | 17.0 | 18.6 | 30.3 |
| 100% scrap | 7.04 | — | — | — | — |
| 80% dross + 20% alloy | 7.58 | 11.1 | 17.5 | 19.1 | 30.3 |
| 80% scrap + 20% alloy | 7.55 | 11.7 | 17.6 | 18.5 | 33.1 |
| 20% scrap + 50% dross + 30% alloy | 7.59 | 11.4 | 17.4 | 19.7 | 31.4 |
| 50% scrap + 50% dross | 7.59 | 11.6 | 17.7 | 18.5 | 33.1 |

As shown in Table 5, the sinterability of dross or scrap particles was substantially improved by adding 0.1% zinc stearate prior to jet milling, reducing particle size to 1-2 microns, and increasing the sintering temperature. The fully densified magnets were made from up to 100% dross or blends of up to 80% scrap and 20% virgin alloy. The blend of 20% scrap +50% dross and +30% virgin alloy was also fully densified at 1050° C. sintering. It is noted that with a small addition of zinc stearate and reducing particle size, the coercivity and loop squareness (Hk) as well as density were substantially improved. Since a fully dense magnet was made from 100% dross particles at 1050°, it was attempted to make magnets from blends of dross and scrap particles. The densities and the magnetic properties of the blends sintered at 1030° C. are listed in Table 6.

TABLE 6

Density and Magnetic Properties of Magnets, Sintered at 1030° C., Made From Blends of Hydrided Scrap and Dross Particles (0.1% Zinc Stearate added)

| | D (g/cc) | Br (kG) | Hk (kOe) | Hci (kOe) | (BH) max (MGO) |
|---|---|---|---|---|---|
| 100% dross | 7.57 | 10.9 | 16.6 | 18.8 | 28.4 |
| 80% dross + 20% scrap | 7.58 | 10.95 | 17.5 | 18.9 | 29.2 |
| 60% dross + 40% scrap | 7.59 | 11.15 | 18.4 | 19.3 | 30.2 |
| 40% dross + 60% scrap | 7.52 | 11.20 | 18.0 | 18.6 | 30.3 |

As shown in Table 6, all blends of dross and scrap (up to 60%) were fully densified at 1030° C. sintering, and exhibited good magnetic properties. This indicates that the dross and scrap particles can be processed into fully dense magnets without the addition of virgin alloy.

Since the particles were previously blended after jet milling, it was attempted to blend particles prior to jet milling. The densities and the magnetic properties of blends sintered at 1050° are listed in Table 7.

TABLE 7

Density and Magnetic Properties of Magnets, Sintered at 1050° C., Made From Blended Powders Prior to Jet Milling (0.1% Zinc Stearate added)

| | D (g/cc) | Br (kG) | Hk (kOe) | Hci (kOe) | (BH) max (MGO) |
|---|---|---|---|---|---|
| 30% scrap + 70% dross | 7.59 | 11.0 | 17.5 | 18.8 | 29.2 |
| 20% scrap + 50% dross + 30% | 7.59 | 11.2 | 18.6 | 19.7 | 30.5 |

TABLE 7-continued

Density and Magnetic Properties of Magnets. Sintered at 1050° C., Made From Blended Powders Prior to Jet Milling (0.1% Zinc Stearate added)

| | D (g/cc) | Br (kG) | Hk (kOe) | Hci (kOe) | (BH) max (MGO) |
|---|---|---|---|---|---|
| alloy | | | | | |

As shown in Table 7, magnets made from particles blended prior to jet milling were fully densified and exhibited good magnetic properties. These data indicate that the dross and scrap particles (and virgin alloy particles) may be blended either prior to or after jet milling. The lubricants, such as zinc stearate, should be blended prior to jet milling, which improves the jet milling practice.

As may be seen from the experimental results reported above with respect to the invention, rare earth element, iron and boron dross and/or scrap materials can be converted into high performance magnets by hydriding prior to jet milling and by properly blending these hydrided powders with each other or with virgin alloy hydrided powder. This permits 100% recovery of the otherwise unusable rare earth element, iron and boron alloy in this dross and scrap material, which recovery is achieved in a simple and economical fashion without resorting to complicated and costly prior-art recovery practices.

For purposes of this invention, the term "scrap" is defined as a rare earth element, iron and boron alloy product having an oxygen content greater than 0.3 weight percent, which product resulted from previously cast or atomized alloy followed by sintering. The term "dross" is defined as the refuse from the melting of a rare earth element, iron and boron alloy which contains a quantity of the melted alloy and has an oxygen content greater than 0.5 weight percent and a nitrogen content greater than 0.1 weight percent. The term "virgin alloy particles" is defined as a rare earth element, iron and boron alloy product that has been previously cast or atomized, but has not been sintered.

What is claimed is:

1. A method for producing sintered permanent magnets of a permanent magnet alloy comprising a rare earth element, iron and boron, said method comprising providing permanent magnet, rare earth element, iron and boron alloy material selected from one of:

a) dross alloy and up to 6% scrap alloy;

b) dross alloy and virgin alloy; and c) dross alloy and virgin alloy and greater than 0 to 80% scrap alloy, sequentially hydriding said material in a hydrogen atmosphere to hydride and decreptitate said material to form particles therefrom, reducing the size of said particles, compacting said particles and dehydriding and sintering the particles to produce a substantially fully dense article for use as a permanent magnet.

2. A method for producing sintered permanent magnets of a permanent magnet alloy comprising a rare earth element, iron and boron, said method comprising sequentially subjecting dross of said alloy to a hydrogen atmosphere to hydride and decrepitate said dross to form particles therefrom, reducing the size of said particles, compacting said particles and dehydriding and sintering the particles to produce a substantially fully dense article for use as a permanent magnet.

3. A method for producing sintered permanent magnets of a permanent magnet alloy comprising a rare earth element, iron and boron, said method comprising subjecting dross of said alloy to a hydrogen atmosphere to hydride and decrepitate said dross to form first particles, subjecting rare earth element, iron and borin virgin alloy to a hydrogen atmosphere to hydride and decrepitate said virgin alloy to form second particles, reducing the size of said first and second particles, blending said first and second particles to produce a particle mixture, sequentially compacting said particle mixture and dehydriding and sintering the particle mixture to produce a substantially fully dense article for use as a permanent magnet.

4. A method for producing sintered permanent magnets of a permanent magnet alloy comprising a rare earth element, iron and boron, said method comprising subjecting scrap of said alloy to a hydrogen atmosphere to hydride and decrepitate said scrap to form first particles, subjecting dross of said alloy to a hydrogen atmosphere to hydride and decrepitate said dross to form second particles, reducing the size of said first and second particles, blending said first and second particles to produce a particle mixture of up to 60% first particles and balance second particles, and sequentially compacting said particle mixture and dehydriding and sintering the particle mixture to produce a substantially fully dense article for use as a permanent magnet.

5. A method for producing sintered permanent magnets of a permanent magnet alloy comprising a rare earth element, iron and boron, said method comprising subjecting scrap of said alloy to a hydrogen atmosphere to hydride and decrepitate said scrap to form first particles, subjecting dross of said alloy to a hydrogen atmosphere to hydride and decrepitate said dross to form second particles, subjecting rare earth element, iron and boron virgin alloy to a hydrogen atmosphere to hydride and decrepitate said virgin alloy to form third particles, reducing the size of said first, second and third particles, blending said first, second and third particles to produce a particle mixture of up to 80% first particles and balance second and third particles, and sequentially compacting said particle mixture and dehydriding and sintering the particle mixture to produce a substantially fully dense article for use as a permanent magnet.

6. The method of claims 1 or 2 or 3 or 4 or 5 wherein the size of said particles is reduced by jet milling.

7. The method of claim 6 wherein said particles are blended with 0.01 weight percent to 1 weight percent lubricant prior to said jet milling.

8. The method of claim 7 wherein said lubricant includes zinc stearate or iron stearate.

9. The method of claim 7 wherein an average particle size of said jet milled powder is 1 to 4 microns.

10. The method of claims 1 or 2 or 3 or 4 or 5 wherein the hydrogen atmosphere is at a pressure of 1 to 400 psi for 2 to 4 hours.

11. The method of claim 10 wherein said hydrogen atmosphere is at a room temperature or a temperature of 200°-300° C.

12. The method of claims 1 or 2 or 3 or 4 or 11 wherein said article is heat treated at a temperature of 550°-650° for 1 to 3 hours in an inert atmosphere or vacuum and is then quenched.

13. The method of claim 8 wherein an average particle size of said jet milled powder is 1 to 4 microns.

* * * * *

UNITED STATES PATENT AND TRADEMARK OFFICE

CERTIFICATE OF CORRECTION

PATENT NO. : 5,091,020

DATED : February 25, 1992

INVENTOR(S) : Andrew S. KIM

It is certified that error appears in the above-identified patent and that said Letters Patent is hereby corrected as shown below:

Claim 11, column 8, line 60, delete "a" (first occurrence).

Claim 12, column 8, line 62, change "11" to --5--.

Signed and Sealed this

Fourth Day of May, 1993

*Attest:*

*Attesting Officer*

Michael K. Kirk

MICHAEL K. KIRK

*Acting Commissioner of Patents and Trademarks*